United States Patent [19]

Nakao

[11] 4,266,289

[45] May 5, 1981

[54] CALENDAR CORRECTING MECHANISM

[75] Inventor: Hideyuki Nakao, Tokyo, Japan

[73] Assignee: Kabushiki Kaisha Daini Seikosha, Tokyo, Japan

[21] Appl. No.: 963,740

[22] Filed: Nov. 27, 1978

[30] Foreign Application Priority Data

Nov. 30, 1977 [JP] Japan ..... 52-144151

[51] Int. Cl.[3] ..... G04B 19/24

[52] U.S. Cl. ..... 368/35

[58] Field of Search ..... 58/58, 23 D, 128, 126 B, 58/4 R; 368/28, 31, 34, 35, 38

[56] References Cited

U.S. PATENT DOCUMENTS

| | | | |
|---|---|---|---|
| 3,673,789 | 7/1972 | Tsuzuki et al. | 368/38 |
| 3,716,983 | 2/1973 | Tanaka et al. | 368/38 |
| 3,827,234 | 8/1974 | Imanishi | 368/38 |
| 3,931,703 | 1/1976 | Scherrer et al. | 58/85.5 |
| 3,992,868 | 11/1976 | Tamaru et al. | 58/58 |
| 4,026,100 | 5/1977 | Kume et al. | 368/37 |
| 4,102,122 | 7/1978 | Tanaka | 58/58 |
| 4,188,774 | 2/1980 | Besson | 368/38 |

*Primary Examiner*—Vit W. Miska

*Attorney, Agent, or Firm*—Robert E. Burns; Emmanuel J. Lobato; Bruce L. Adams

[57] ABSTRACT

A calendar correcting mechanism for an electronic timepiece including a movable calendar member having dates thereon, and a switch cooperative with the movable calendar member for switching between electrical signals to discriminate between the 30-day and 31-day months. A motor drives the movable calendar member to display different dates. A calendar correcting circuit is responsive to the electrical signals switched by the switch for operating the motor to correct the month-end date of 30-day months by rapidly advancing the movable calendar mechanism from the 30th day to the first day of the month so as not to display the 31st day of the month.

2 Claims, 10 Drawing Figures

CALENDAR CORRECTING MECHANISM

BACKGROUND OF THE INVENTION

The present invention relates to an automatic correction mechanism for correcting the month-end dates of an electronic timepiece provided with a calendar.

Conventionally, the month-end dates of the timepiece are automatically corrected by the following method: Namely, the month-end dates of 30-day months are corrected by providing a cam and a lever to discriminate between 30-day months and 31-day months, and wheels of larger reduction ratio or the like.

In this case, however, since the teeth modules of the wheels are limited to some extent, the reducing steps of the wheels should be increased in order to modulate and the number of wheels become large, whereby the assembly and production of the timepiece has become complicated. Moreover, in order to set a calendar, the winding stem should be wound several times looking at the month displaying wheel, whereby the handling of the timepiece is troublesome.

Accordingly, it is an object of the present invention to provide an electronic timepiece having a motor to automatically correct the month-end dates of the calendar, wherein a counting circuit counts the signal except the normal time displaying signal and discriminates between the 30-day months and 31-day months and produces the signal to drive said motor, thereby to eliminate the above mentioned difficulty and insufficiency.

DESCRIPTION OF THE PREFERRED EMBODIMENT

Figure 1:
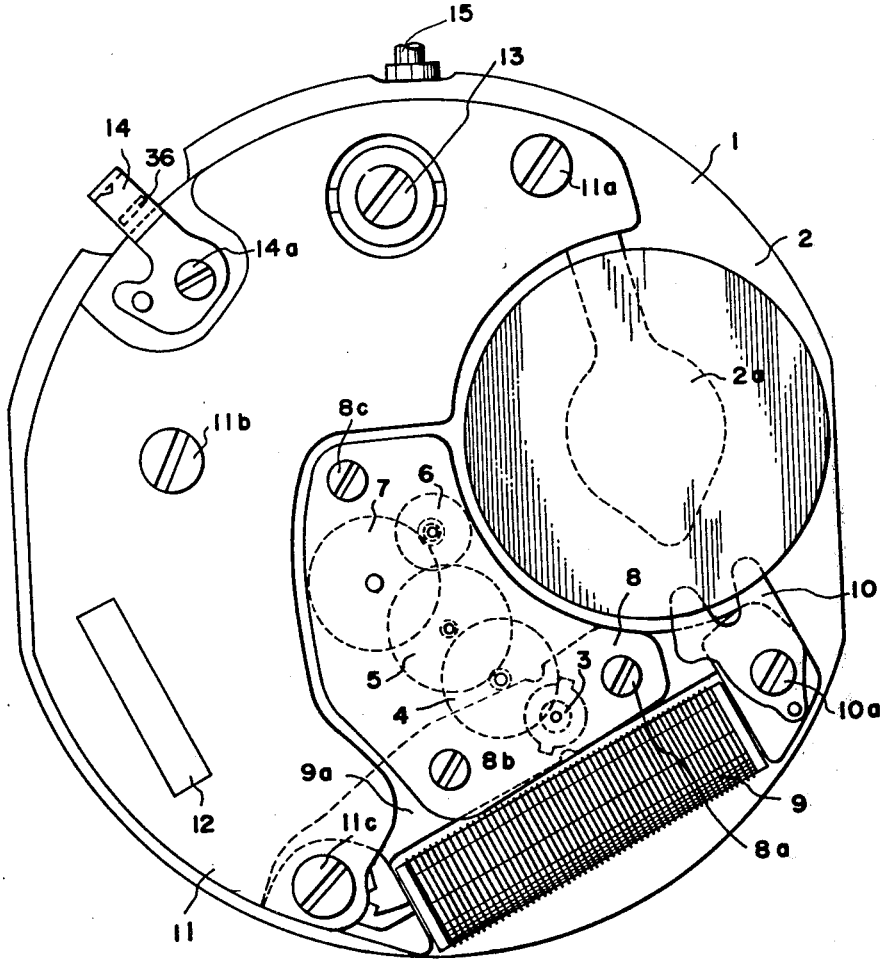
FIG. 1 is a plan view of a movement side of a timepiece provided with an automatic correction of a calendar according to the present invention.

FIG. 1 is a plan view of the present invention wherein numeral 1 is a plate, 2 is a battery to drive a circuit, motor and the like, 2*a* is a lead plate conducting to the anode of the battery 2, and 10 is a lead plate conducing to the cathode of the battery 2. Numeral 11 is a circuit block provided with a lead plate and integrated circuit (not shown) fixed to the timepiece movement by the screws 11*a*, 11*b* and 11*c*. A quartz crystal unit 12 and a trimmer condenser 13 for watch timing adjustment, which are molded by electrically insulated resin, are mounted on the circuit block 11. A switch composed of a switching terminal 36, and a switching spring 14 are provided on the circuit block 11 by way of a screw 14*a*. The gear train of the movement side is composed to transmit the power in turn from a rotor 3 to wheels 4, 5, 6 and 7. Numeral 8 is a supporting member which supports the said gear train of the movement side, and 8*a*, 8*b* and 8*c* are screws which fix the supporting member 8. A motor to drive the gear train of the movement side is composed of a coil block 9 and a stator 9*a*. 10*a* is a screw which fixes the lead plate 10, the stator 9*a* and the coil block 9.

Figure 2:
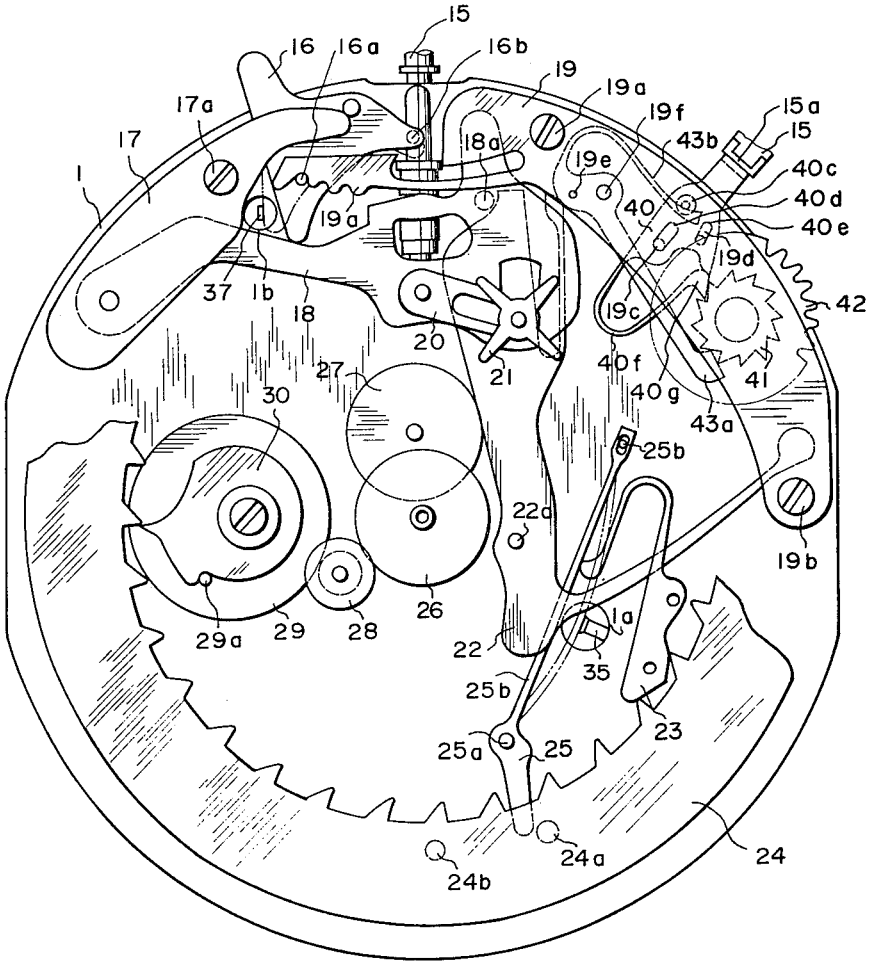
FIG. 2 is a plan view of a dial side of FIG. 1 showing a driving mechanism of a month display member and a switching mechanism of a month-end automatic correction.

Referring then to FIG. 2, numeral 15 is a winding stem which is inserted into the plate 1. Numeral 16 is a setting lever provided with a pin 16*b* which fits with the winding stem 15 and a pin 16*a* which fits with a jagged portion 19*a* of a setting lever spring 19. Numeral 17 is a setting lever axle fixed by a screw 17*a*. The setting lever 16 is positioned by the jagged portion 19*a* of the setting lever spring 19. Numeral 18 is a clutch lever provided with a rocking lever 20 having a correcting wheel 21 to correct a date dial 24 and a pin 18*a* which fits with a lever 22 which swings centering around a pin 22*a* driven into the plate 1.

The driving power of the gear train from the movement side drives a center wheel and pinion and the power is transmitted to a minute wheel 27, an hour wheel 26, intermediate date wheel 28 and a date driving wheel 29. Whereby a date-finger 30 is driven by way of a pin 29*a* provided on the date driving wheel 29 to thereby rotate the date dial 24. The position of the date dial 24 is determined by way of a date jumper 23. Pins 24*a* and 24*b* provided on the date dial 24 help a switching lever 25 to rotate centering around a pin 25*a* and the other end of the switching lever 25 is supported by a pin 25*b*. Between the setting lever spring 19 and the plate 1 there is provided a month displaying mechanism which interlocks with the switch provided on the circuit block 11 at the time of setting operation of the calendar correction.

Figure 3:
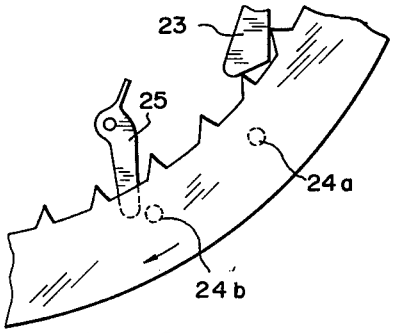
FIG. 3 is an enlarged plan view of the switching mechanism of the month-end automatic correction showing the state that the first signals of each of the months are fed.

The said month displaying mechanism is composed of a lever 40, a member 43 provided with a spring portion 43*b*, a jumper portion 43*a*, a pawl wheel 41 and a driving wheel 42 which rotates together with the pawl wheel. Referring to the operation of the illustrated structure, FIG. 3 shows a state in which the 28th day is displayed from a date window not shown and the switching pin 24*b* provided at the date dial 24 and the switching spring 25 fit each other.

Figure 4:
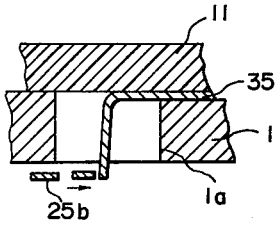
FIG. 4 is an enlarged sectional view of the switching mechanisms of the month-end automatic correction shown in FIG. 2.

When the date advances from the 28th to the 29th, the switching spring 25 is rotated by the pin 24*b* and the spring portion 25*b* of the switching spring 25 flexes in the state shown by way of a two dot chain line shown in FIG. 2 to thereby contact with a switching terminal 35 protruding from the circuit block 11 and conduct electrically. FIG. 4 is a grossly enlarged sectional view showing an operating condition of the switching portion.

When the date advances to the 30th, the switching pin 24*a* provided on the date dial 24 becomes positioned as shown in FIG. 2 and when the date dial 24 is advanced from the 30th to the 31th, the switching pin 24*a* rotates the switching lever again and thereby the switch comprised of switching terminal 35 is "ON" again. Namely, the signal is fed twice from the switching mechanism into the months except in the case of the month of February.

Figure 6:
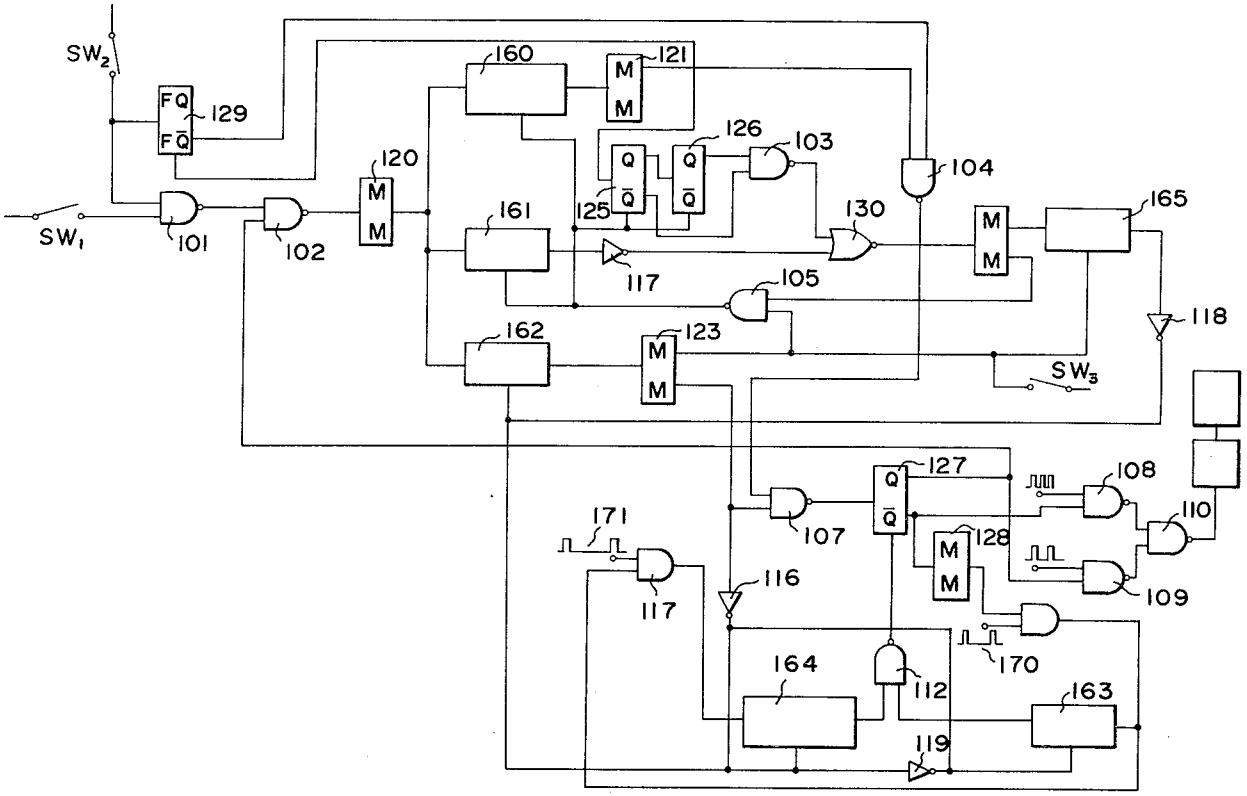
FIG. 6 is a circuit diagram of four years' calendar automatic correction according to the present invention.

Referring to the circuit in conjunction with FIG. 6, the signal fed from the switching mechanism is a signal to drive the motor, i.e. the signal is fed from the $SW_1$ to counters 160, 161 and 162. The counter 160 is a four step counter which counts the signal twice a month to thereby discriminate between 30-day months and 31-day months. The counter 161 is a 10-step counter which produces the signal to reset the counters 160 and 161 in July and December, while the counter 162 drives the motor only in February. Though the signal is simultaneously fed to each of the counters 160, 161 and 162, the counter 160 does not produce the signal until display of July finishes. On the other hand, the signal from the counter 162 is stopped by a counter 165 which counts the reset signal produced when July and December of the counter 161 finishes and an an inverter 118. In case the circuit operates from March, if the signal is fed on March 28th, March 30th, April 28th and April 30th respectively being about to change to the next days, the signal to advance the motor fast is produced from the 4 step counter 160. The signal in one side is fed to a NAND circuit 107 via a mono-multi 121 and a NAND circuit 104. The signal produced from the NAND circuit 107 is fed to a flip-flop 127 (hereinafter FF) the Q output thereof being "0" and $\overline{Q}$ output being "1", whereby the $\overline{Q}$ output of the FF 127 is inverted to "1" and $\overline{Q}$ output is inverted to "0". Then the normal pulse produced from a NAND circuit 109 is stopped and the fast advancing pulse is produced from a NAND circuit 108 instead and advances the motor fast by way of a NAND circuit 110 and a buffer.

On the other hand, the signal produced from the Q output of the FF 127 opens an AND circuit 111 via a mono-multi 128 and extracts the signal of longer pulse period from the dividing steps to be counted by a counter 163. A reset signal for the counter 163 is removed by an inverter 119. Two signals out of the signals produced from the 4-step counter 160 pass a mono-multi 120 and one is fed to a FF 129 and the other is fed to a FF 125, the Q output thereof being "1" and the $\overline{Q}$ output being "0". On May 28th, May 30th, June 28th and June 30th, the signal is fed from $SW_1$ and the output produced from the counter 160 is fed to the FF 129, the NAND circuit 104 and the FF 125. The signal fed to the NAND circuit 104 becomes the signal to advance the motor fast and the signal fed to the FF 125 is fed to a FF 126, the Q output thereof being "0" and $\overline{Q}$ output being "1". Then the FF 126 is inverted and the Q output becomes "1" and $\overline{Q}$ becomes "0", and thereby the inputs of a NAND circuit 103 become "1, 1" and the output becomes "0". When the signal is fed from $SW_1$ to the counter 161 on July 28th and July 30th, one input of a NOR circuit 130 becomes "0" though it remains "1" until June, and the signal is produced from the counter 161, whereby the input of an inverter 117 becomes "1" and the output becomes "0".

At this time, one input side of the NOR circuit 130 becomes "0" at the end of June and thereby the signal is produced form the NOR circuit 130.

The counter 163 is a counter to correct the time which the hand advanced fast by 24 hours and checks for the false indication of time when the time indication returns to the normal state. The signal produced from the counter 163 is fed to a NAND circuit 112 and the signal from the NAND circuit 112 resets the FF 127 and the counter 163.

Subsequently, the signal produced from the NOR circuit 130 is fed to a mono-multi 122 and one output signal resets the counters 160 and 161, while the other signal is fed to the binary circuit 165. In this case the motor is not advanced fast since the output is not produced from the counter 160. The circuit operation from August to December is as follows: The circuit operation of August is the same as that of March, September is the same as that of April, October is the same as that of May, November is the same as that of June and December is the same as that of August. Then in December, the counter 165 produces the output signal in response to the signal fed thereto and inverts the output of inverter 118 and removes the reset of the binary counter 162 which operates only in February. When the signal is fed on January 28th, January 30th and February 28th, the signal is produced from the counter 162 and then one of the signal is fed to the NAND circuit 107 by way of a mono-multi 123 and advances the motor fast inverting the FF 127 as mentioned above. On the other hand, the output signal from the mono-multi 123 inverts the inverter 116 and resets the counter 163. The counter 164 corrects 3-days hand setting time and the fast advancing time of the motor, whereby the false indication of time in case the time indication returns to the normal state is checked likewise for the counter 163. Then the output from the AND circuit 111 opens an AND circuit 115 and allo-s the counter 164 to count the pulse having the same period as the pulse 171 extracted from the dividing circuit or the pulse having the longer period. The output from the counter 164 is fed to the NAND circuit 112 and resets the FF 127 simultaneously with resetting the counter 164. The FF 129 stops the motor fast advancing signal in case a reset signal of the calendar automatic correcting circuit is fed from the switch $SW_2$.

Referring then to the setting mechanism of the circuit.

The circuit structure described above starts from March each year and thereby it is necessary to reset the month at the month one starts to use the timepiece. A rotary bezel displaying four year's month shown in FIG. 7 is provided to indicate what month the signal fed from the switch indicates, therefore it is necessary to set March indicated by the rotary bezel at the predetermined position such as twelve o'clock or the like.

Figure 8:
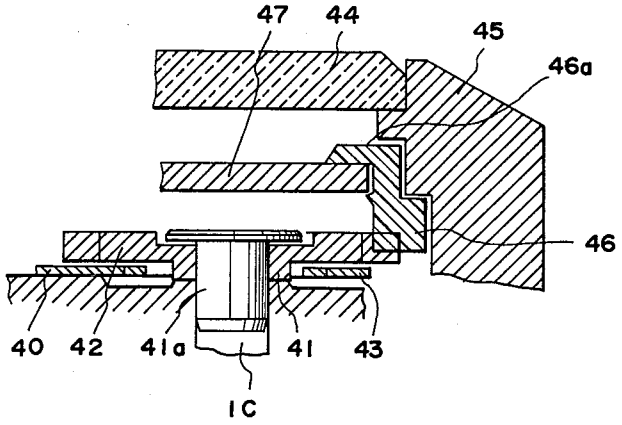
FIG. 8 is a sectional view showing the fitting condition of the rotary bezel provided with the month display, the driving wheel which drives the rotary bezel and the pawl wheel.

Referring to the setting operation of the rotary bezel in conjunction with FIG. 2. If the external operating member 15 provided with a member 15*a* consisting of an electrically insulating member is pushed, a lever 40 moves in the predetermined directions by pins 19*c* and 19*d* provided on the setting lever spring 19 and the working range thereof is determined by elliptic holes 40*d* and 40*e* of the lever 40. A pawl portion 40*g* provided at an end of a spring portion rotates the pawl wheel 41 as well as the driving wheel 42 which is in one body with the pawl wheel by operation of the lever 40, whereby the rotary bezel which fits with the driving wheel 42 rotates together. The amount of rotation of the pawl wheel 41 is fixed by a front end portion 43*a* of the jumper member 43. The jumper member 43 is mounted on the setting lever spring 19 by pins 19*e* and 19*f*. Other spring portion 43*b* provided with the jumper member 43 fits with a pin 40*c* provided with the lever 40 and usually pushes the lever 40 up in the external direction of the timepiece. FIG. 8 shows the relation between the rotary bezel 46 and the driving wheel 42, wherein 41 is the pawl wheel, 40 is the lever and 43 is the jumper member. 41*a* is driven into the hole 1*c* of the plate and holds the driving wheel 42 which is in one body with the pawl wheel 41.

Figure 7:
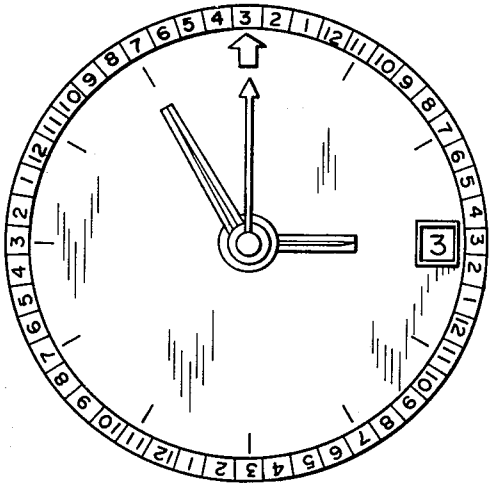
FIG. 7 shows a four years' month display provided with a rotary bezel.

46*a* is a rotary bezel displaying four years' month shown in FIG. 7 wherein numeral 47 is a dial, 44 is a glass and 45 is a case. When all the circuits are reset in the state that the rotary bezel is set at the position shown in FIG. 7, the circuits are constructed to start from March.

Referring then to a resetting operation. The switching terminal 36 from the circuit extending from a hole 1*b* of the plate is provided sectionally in the same way as a switching terminal 35 extending from the circuit shown in FIG. 4. When the winding stem 15 is pushed in a central direction of the timepiece, the setting lever 16 contacts and electrically conducts and thereby the circuit is reset. The switch is shown as $SW_3$ in the circuit diagram of FIG. 6.

Figure 5:
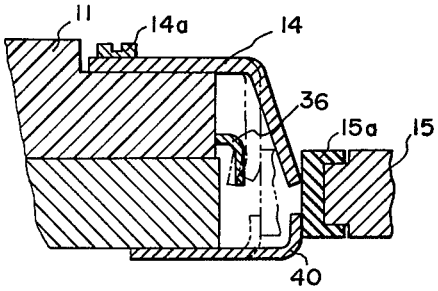
FIG. 5 shows the calendar automatic correcting switch and the month displaying member which operates interlockingly.

Referring to a signal feeding mechanism from March to the month one starts to use the timepiece, in FIG. 5, when the external operating member 15 is pushed, the switching spring 14 is pushed simultaneously with the operation of the lever 40 and the switching spring 14 is pressed to the position shown by way of a two dot chain line so as to contact the switching terminal 36, whereby the electric contact is kept and a signal to set at the month one starts to use the timepiece is fed thereto. The switch is shown as $SW_2$ in the circuit diagram of FIG. 6. In the operation mentioned so far, the setting of the calendar automatic correcting circuit completes, while the date of the calendar is corrected by the correcting wheel 21 shown in FIG. 2 which interlocks with the changing mechanism of the prior art.

Although the structure illustrated and described so far have been concerned with four years' calendar automatic correction, it is possible to set one year's calendar automating correction in order to simplify the setting operation of the calendar.

Figure 9:
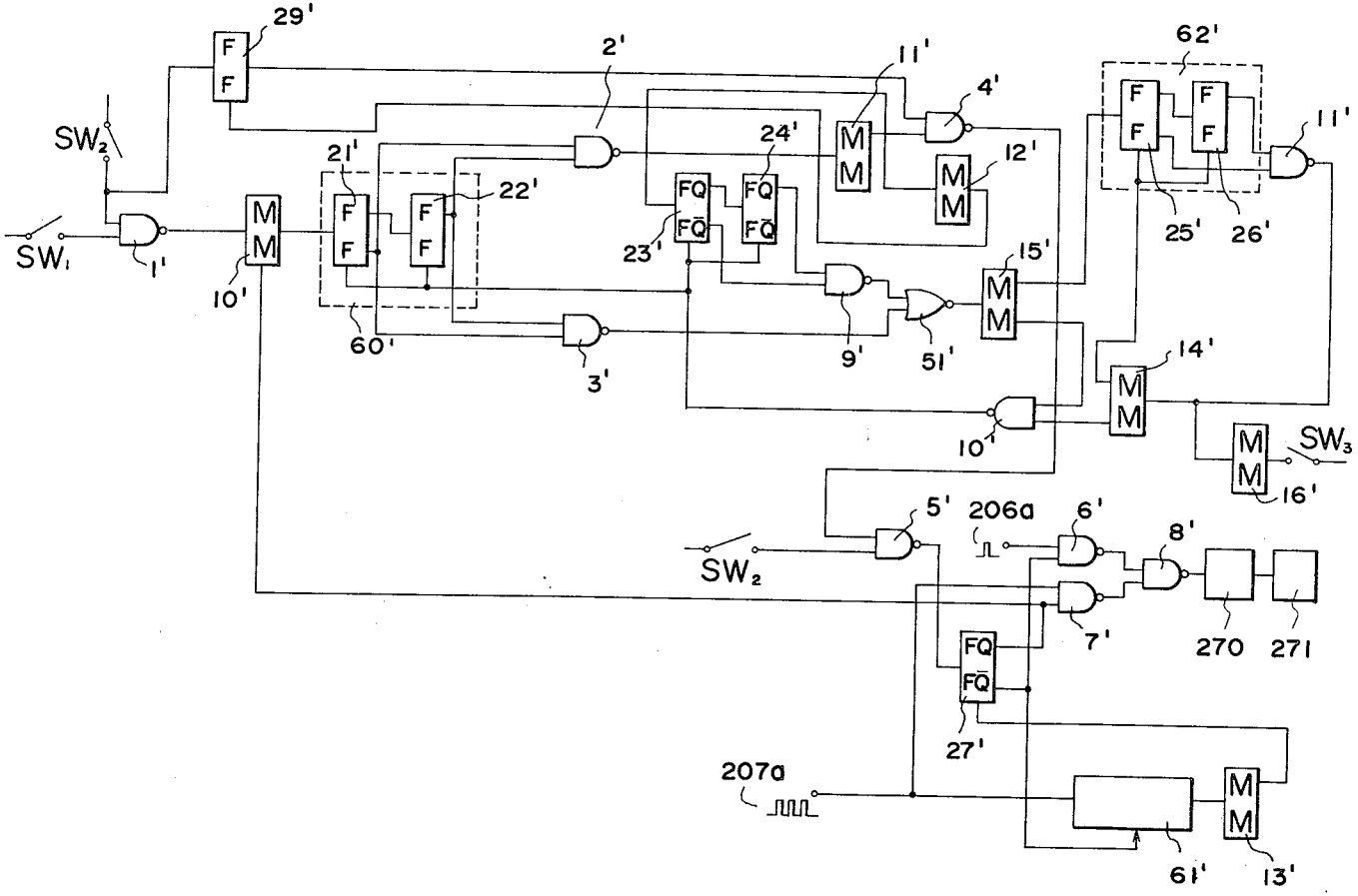
FIG. 9 is a circuit diagram of one year's calendar automatic correction according to the present invention.

The above can be done by eliminating the pin 24*b* which operates when the 28th day is changed to the 29th day each month to thereby feed the signal once a month, and by use of an electric circuit as illustrated in FIG. 9. The circuit of FIG. 9 operates from March similarly to that illustrated in FIG. 6 and the signal from the switching mechanism provided on the calendar member is fed from $SW_1$.

When the calendar is advanced to March 30th and the signal is fed from $SW_1$, the signal is fed to a binary counter 60' composed of FF 21' (hereinafter flip flop is referred to FF) and FF 22' which discriminates between a 30-day month and a 31-day month by way of a NAND circuit 1' and a mono-multi 10'.

This time the counter 60' doesn't produce an output since it counts only one signal, whereby the motor doesn't drive to correct the calendar. The mono-multi 10' is provided in order to prevent a misoperation of the circuit caused by noise or the like and operate the circuit correctly. Subsequently, when the signal is fed again from $SW_1$ after advancing the calendar of April 30, the binary counter 60' counts the signal. Then the output is produced when the binary counter 60' counts the signal twice, and the output is produced from a NAND circuit 2'. The output is fed to a NAND circuit 5' by way of a mono-multi 11' and a NAND circuit 4'. The output is also produced from a NAND circuit 3' by the output from the counter 60'. On this occasion the Q output of the FF 23' and FF 24' are "0" and $\overline{Q}$ output is "1", whereby inputs of a NAND circuit 9' are "1" and "0" and the output is "1".

Although the output is produced from the NAND circuit 3', a NOR circuit 51' does not produce the signal since the output of the NAND circuit 9' is "1". The signal fed to the NAND circuit 5' is fed to the FF 27'. Before said signal is fed, Q output of FF 27' being "1" and $\overline{Q}$ being "0", and opens the NAND circuit 6' and produces a normal pulse 206*a* as an output, while it closes a NAND circuit 7' and stops the fast advancing pulse, whereby a NAND circuit 8' drives the motor passing the normal pulse 206*a* through a buffer.

The Q output of the FF 27' resets a binary counter 61'. When the output from the NAND circuit 5' is fed to the FF 27', Q of the FF 27' is "0" and $\overline{Q}$ is "1", thereby closing the NAND circuit 6' and stopping the normal pulse 206*a* opening the NAND circuit 7'. Therefore the fast advancing pulse 207*a* is produced from the NAND circuit 8' in place of the normal pulse 206*a* by way of the buffer to thereby drive the motor. The output from $\overline{Q}$ of the NAND circuit 27' releases the reset of the counter 61' whereby the counter 61' starts counting simultaneous with driving of the motor by the fast advancing pulse.

A false indication by the automatic correction of the calendar is prevented since the capacity of the counter 61' is determined in consideration of the pulse produced during the hour hand of the timepiece rotates twice around and the period during which the motor is driven by said fast advancing pulse. When the counter 61' stops counting, the output is produced and resets the FF 8' by way of a mono-multi 12'. Then the Q output of the FF 8' becomes "1" again and closes the NAND circuit 7' and stops the fast advancing pulse 207*a*, while the $\overline{Q}$ output of the FF 8' becomes "0" again and opens the NAND circuit 6' and produces the normal pulse 206*a*. The normal pulse 206*a* restores the motor to the normal state by way of the NAND circuit 8' and the buffer.

On the other hand, one output of the mono-multi 11' is fed to a mono-multi 12' and resets the FF 29', whereby the output from the FF 29' operates to produce the output in an instant the signal is fed to the NAND circuit 4'.

The other output of the mono-multi 11' is fed to the FF 23'. The Q and $\overline{Q}$ outputs of both the FF 23' and FF 24' are respectively "0" and "1", whereby if the output of the mono-multi 11' is fed to the FF 23', Q output thereof is "1" and $\overline{Q}$ is "0". Subsequently, when the calendar is advanced to May, the signal is fed through the switch $SW_1$. The operation of the circuit in case of May is the same as March since May is a 31-day month. The operation of the circuit in case of June is a 30-day month. When the signal is advanced to June, the Q output of the FF 23' is "0" and $\overline{Q}$ is 37 1" and the Q output of the FF 24' is "1" and $\overline{Q}$ side whereof is "0".

Then the input of the NAND circuit 9' is "1" and the output is "0". When the calendar is advanced to July in the above state and the signal is fed from the switch $SW_1$, the outputs of the NAND circuit 2' and the NAND circuit 3' are respectively "0" by the output $\overline{Q}$ of the FF 21' of the counter 60'. When the output from the AND circuit 3' is 37 0" and in case of June as mentioned above, the output from the NAND circuit 9' is "0" and thereby the output is produced from the NOR circuit 51'.

The output from the NOR circuit 51' is fed to a mono-multi 15' and one output from the mono-multi 15' is fed to the FF 25' which compose a counter 62' the operation of which will be illustrated later. The other output from the mono-multi 15' is fed to the NAND circuit 10'. This time since the input of the mono-multi 14' is "0", the output produced from the NAND circuit 10' resets the FF 21', the FF 22' which comprise the counter 60' and also the FF 23' and FF 24'.

This is the same state as the state before counting the signal of March excluding the FF 25' and the FF 26'.

Namely, since both July and August are 31-day months, the counter 60', the FF 23' and the FF 24' are reset by the signal produced by advancing the calendar of July and the fast advancing pulse of April and June, whereby the motor is not driven in case of August. The circuit operation of August is the same as that of March, the circuit operation of September is the same as that of April, the circuit operation of October is the same as that of May, the circuit operation of November is the same as that of June, the circuit operation of December is the same as that of July and the circuit operation of next January is the same as that of August. In case of January, the reset pulse produced in case of July is counted in the binary counter and the reset pulse of January is counted by the the counter 62', whereby the output is produced and fed to the NAND circuit 10' via the mono-multi 14' and resets the counter 60', the FF 23' and the FF 24'. And at the same time the counter 62' is reset by the other output produced from the mono-multi 14'. Namely, the circuit operation of January is the same as that of March since the counters 60' and 62', the FF 23' and FF 24' are reset.

The pin 25 provided at the date dial is arranged to allow the signal to enter after advancing the calendar of the month-end date of a 30-day month, whereby the pin 25*a* and the switch lever do not contact in case of February and the calendar is not corrected automatically. Therefore, when February 29th is displayed, it is necessary to advance the calendar fast to March 1st manually.

Figure 10:
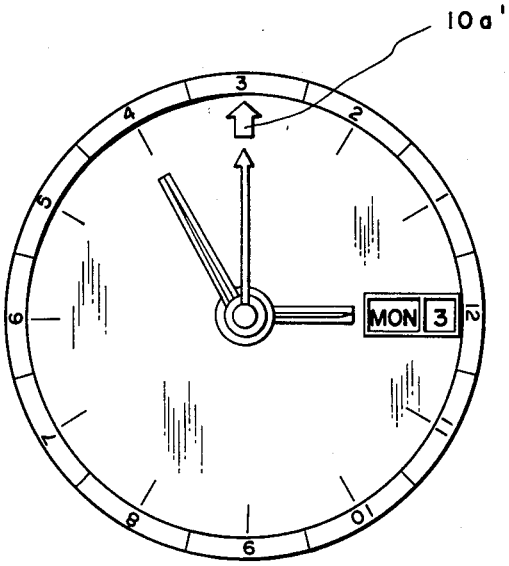
FIG. 10 shows one year's month display provided on the rotary bezel according to the present invention.

A calendar automatic correcting mechanism can be set by setting the month display provided on the rotary bezel in one year's month display similarly to FIG. 10 and the ratio of the number of the teeth to drive the rotary bezel is corrected.

As mentioned so far, the calendar of 30-day months is automatically corrected according to the present invention, whereby the troublesomeness of the calendar month-end date correction is eliminated.

Moreover, the calendar month-end date correcting mechanism is composed of an electronic circuit and thereby the number of parts can be decreased when compared with the conventional type correcting mechanism. When the month-end date correction of the calendar is set, the correcting operation such as fast advancing of the motor is not done, whereby power required for fast advancing is not consumed by the motor.

Furthermore, the month display member which interlocks with the switch is provided, whereby it is not necessary to memorize a number to feed the signal.

I claim:

1. A calendar correcting mechanism of an electronic timepiece of the type having a battery power source, the calendar correcting mechanism comprising: a movable calendar member having dates thereon and movable for displaying different dates; switching means cooperative with said movable calendar member for switching between electrical signals to discriminate between 30-day months and 31-day months; a motor for driving said movable calendar member to display different dates; resettable calendar correcting circuit means responsive to the electrical signals switched by said switching means for operating said motor to correct the month-end date of 30-day months by rapidly advancing said movable calendar mechanism from the 30th day to the first day of the month so as not to display the 31st day of the month; a month display member; a correction lever operable for correcting the setting of said month display member; a reset switch for switching a resetting signal applied to reset said calendar correcting circuit means; a month setting switch for switching a month setting signal applied to set said calendar correcting circuit means to the month at which the timepiece starts to be used; and an externally operable member including means for simultaneously actuating said correction lever and said month setting switch.

2. A calendar correcting mechanism according to claim 1, wherein said switching means consists essentially of mechanical switching means.

* * * * *